US008534510B2

(12) United States Patent
Parra et al.

(10) Patent No.: US 8,534,510 B2
(45) Date of Patent: Sep. 17, 2013

(54) CLOSURE FOR A CONTAINER

(75) Inventors: Michael Parra, Somerset, NJ (US); Jeffrey Mayers, Ridgefield Park, NJ (US); James David Faulkner, Erie, PA (US); Elaine Casey, New York, NY (US); Bruce Cummings, New York, NY (US); Corrine Elstow, Marlborough (GB); Sam Lucking, Cheltenham (GB); John Lamb, Pewsey (GB)

(73) Assignee: Colgate-Palmolive Company, New York, NY (US)

( * ) Notice: Subject to any disclaimer, the term of this patent is extended or adjusted under 35 U.S.C. 154(b) by 356 days.

(21) Appl. No.: 12/847,082

(22) Filed: Jul. 30, 2010

(65) Prior Publication Data

US 2011/0095058 A1 Apr. 28, 2011

Related U.S. Application Data

(60) Provisional application No. 61/230,253, filed on Jul. 31, 2009.

(51) Int. Cl.
*B67D 3/00* (2006.01)

(52) U.S. Cl.
USPC ..... 222/525; 215/329; 215/DIG. 13

(58) Field of Classification Search
USPC .. 222/525, 556, 521, 524, 546; 215/DIG. 13, 215/311, 329, 344, 354, 356, 387; 220/714
See application file for complete search history.

(56) References Cited

U.S. PATENT DOCUMENTS

| | | | | | |
|---|---|---|---|---|---|
| 3,223,269 | A | * | 12/1965 | Williams | 215/318 |
| 3,595,418 | A | * | 7/1971 | Adcock et al. | 215/329 |
| 3,980,211 | A | | 9/1976 | Owens | |
| 4,057,160 | A | | 11/1977 | Victor et al. | |
| 4,132,308 | A | | 1/1979 | Goncalves | |
| 4,172,540 | A | * | 10/1979 | Erichson | 222/517 |
| 4,273,247 | A | * | 6/1981 | Earls | 215/228 |
| D268,567 | S | | 4/1983 | Kojima | |
| 4,387,819 | A | | 6/1983 | Corsette | |
| 4,600,131 | A | | 7/1986 | Roof et al. | |
| 5,131,549 | A | * | 7/1992 | Battegazzore | 215/252 |
| 5,139,182 | A | | 8/1992 | Appla | |

(Continued)

FOREIGN PATENT DOCUMENTS

| | | |
|---|---|---|
| DE | 3327880 | 2/1984 |
| EM | 000249677-0002 | 11/2004 |

(Continued)

OTHER PUBLICATIONS

International Search Report for PCT/US2010/043829 filed Jul. 30, 2010 dated Nov. 11, 2010.

*Primary Examiner* — Kevin P Shaver
*Assistant Examiner* — Daniel R Shearer
(74) *Attorney, Agent, or Firm* — Judy W. Chung

(57) ABSTRACT

A closure for a container, and a container incorporating the same, that minimizes or eliminates leakage between the closure and the container holding the liquid. The closure provides a liquid sealing system that allows irregularly shaped closure tops to be used without sacrificing the effectiveness of the liquid seal. In one embodiment, the closure includes a plurality of struts disposed within an annular space that receives a neck portion of the container to create a seating plane that corresponds to a plane formed by the rim of the neck portion.

22 Claims, 7 Drawing Sheets

(56) References Cited

U.S. PATENT DOCUMENTS

| | | | | |
|---|---|---|---|---|
| 5,275,287 | A | 1/1994 | Thompson | |
| 5,303,850 | A | 4/1994 | Connan | |
| 5,454,489 | A | 10/1995 | Vesborg | |
| 5,495,958 | A | 3/1996 | Konrad et al. | |
| 5,497,906 | A | 3/1996 | Dubach | |
| 5,499,736 | A * | 3/1996 | Kohl | 220/254.5 |
| 6,167,921 | B1 | 1/2001 | Busick et al. | |
| 6,257,463 | B1 * | 7/2001 | De Polo | 222/525 |
| RE38,399 | E | 1/2004 | Montgomery | |
| 6,843,389 | B2 | 1/2005 | Kasting et al. | |
| D503,886 | S | 4/2005 | Biesecker | |
| 6,913,158 | B1 | 7/2005 | Bosl et al. | |
| D508,202 | S | 8/2005 | Dobson et al. | |
| 6,997,354 | B2 | 2/2006 | Kasting et al. | |
| RE39,187 | E | 7/2006 | Randall | |
| 7,175,051 | B2 | 2/2007 | McLelland et al. | |
| 7,216,779 | B2 | 5/2007 | Kasting et al. | |
| D554,995 | S | 11/2007 | Saint-Ignan et al. | |
| 7,308,988 | B2 | 12/2007 | Yashima et al. | |
| D581,787 | S | 12/2008 | Davis et al. | |
| 2003/0042220 | A1 | 3/2003 | Bourreau et al. | |
| 2006/0000792 | A1 | 1/2006 | Hennebelle | |
| 2006/0213862 | A1 | 9/2006 | Smith | |
| 2006/0278642 | A1 | 12/2006 | Pugne et al. | |
| 2009/0101682 | A1 | 4/2009 | Szekely et al. | |
| 2009/0114651 | A1 | 5/2009 | Krebs | |
| 2009/0139953 | A1 | 6/2009 | Py | |

FOREIGN PATENT DOCUMENTS

| | | |
|---|---|---|
| EM | 000595947-0002 | 9/2006 |
| EM | 000641055-0001 | 12/2006 |
| EM | 000641055-0002 | 12/2006 |
| EM | 000751920-0001 | 7/2007 |
| EM | 000751920-0002 | 7/2007 |
| EM | 000975370-0002 | 7/2008 |
| EM | 000975370-0003 | 7/2008 |
| EM | 000975370-0004 | 7/2008 |
| EM | 000979802-0002 | 7/2008 |
| EM | 001065536-0001 | 1/2009 |
| EM | 001065536-0002 | 1/2009 |
| EM | 001103899-0004 | 3/2009 |
| EP | 0079552 | 5/1983 |
| EP | 1304296 | 4/2003 |
| GB | 2124603 | 2/1984 |

* cited by examiner

CLOSURE FOR A CONTAINER

CROSS-REFERENCE TO RELATED PATENT APPLICATIONS

The present application claims the benefit of U.S. Provisional Patent Application No. 61/230,253, filed Jul. 31, 2009, the entirety of which is hereby incorporated by reference.

FIELD

The present invention relates generally to containers, and specifically to a closure suitable for liquid-filled containers.

BACKGROUND

A challenge in modern product packaging has been to provide container caps or closures that are aesthetically interesting to the consumer, provide brand differentiation, are light-weight in construction, economical to produce, and effectively seal the liquid contents of the container. In order to prevent leakage, conventional closures have been generally designed with flat, uniform top surface configurations so that the underside of the closure has a correspondingly flat annular surface for mating with the flat annular neck rim at the mouth of the container. This situation has heretofore limited the freedom of packaging designers in developing interesting cap configurations while still providing a satisfactory liquid seal.

An improved closure is desired that allows different and irregular configurations to be utilized without sacrificing the integrity of the liquid seal.

SUMMARY

A closure is provided that minimizes or eliminates leakage between the closure and a container holding a liquid. The closure provides a liquid sealing system that allows irregularly shaped closure tops to be used without sacrificing the effectiveness of the liquid seal.

In one aspect, the invention can be a container comprising: a container neck forming an opening about an axis, the container neck comprising a rim surface that defines a seating plane; a closure body comprising: a top wall extending radially from the axis; a plug extending axially from the top wall, the plug circumferentially surrounding the axis; a sidewall extending axially from the top wall and circumferentially surrounding the plug so as to form an annular space between the sidewall and the plug; a bottom surface of the top wall defining a roof of the annular space, the bottom surface of the top wall being non-coplanar with a reference plane that is substantially parallel to the seating plane; and a plurality of circumferentially spaced-apart struts in the annular gap, each of the struts having a bottom surface that collectively define the reference plane; and the closure body secured to the container neck, the container neck extending into the annular gap so that the rim surface of the container neck contacts the bottoms surfaces of the struts, the plug extending into the opening of the container neck and forming a seal with the container neck.

In another embodiment, the invention can be a closure for sealing a liquid container comprising: an axis; a top wall extending radially from the axis; a plug extending axially from the top wall, the plug circumferentially surrounding the axis; a sidewall extending axially from the top wall and circumferentially surrounding the plug so as to form an annular space between the sidewall and the plug; a bottom surface of the top wall defining a roof of the annular space, the bottom surface of the top wall being non-coplanar with a reference plane that is substantially perpendicular to the axis; and a plurality of circumferentially spaced-apart struts in the annular gap, each of the struts having a bottom surface that collectively define a seating plane that is substantially perpendicular to the axis.

In yet another aspect, the invention can be a closure for sealing a liquid container comprising: a axis; a top wall extending radially from the axis; a plug extending axially from the top wall, the plug circumferentially surrounding the axis; a sidewall extending axially from the top wall and circumferentially surrounding the plug so as to form an annular space between the sidewall and the plug; a bottom surface of the top wall defining a roof of the annular space, the bottom surface of the top wall having an undulating contour extending circumferentially, the bottom surface having a plurality of low points and a plurality of high points resulting from the undulating contour; and at each low point, a lug formed into the bottom surface of the top wall and comprising a bottom surface, the bottom surfaces of the lugs collectively defining a seating plane that is substantially perpendicular to the axis.

In a still further aspect, the invention can be a closure having a saddle-shaped top wall having a top surface with undulating concave and convex surfaces.

In yet another aspect, the invention can be a closure for a container comprising a body having a top wall and a sidewall extending axially therefrom. The closure may define an interior cavity configured for receiving the neck portion of a container. The closure may further include a sealing tube configured to engage the neck portion of the container for forming a liquid seal. A plurality of radially-extending struts may be provided that span between the sidewall and sealing tube and which are configured to engage the neck portion of the container. The supporting struts collectively define a common seating plane and may structurally reinforce the closure. The closure may further include lugs disposed along the seating plane.

The foregoing and other aspects of a container formed according to principles of the present invention are further described herein.

BRIEF DESCRIPTION OF THE DRAWINGS

The features, and advantages of the invention will be apparent from the following more detailed description of certain embodiments of the invention and as illustrated in the accompanying drawings in which.

Figure 1:
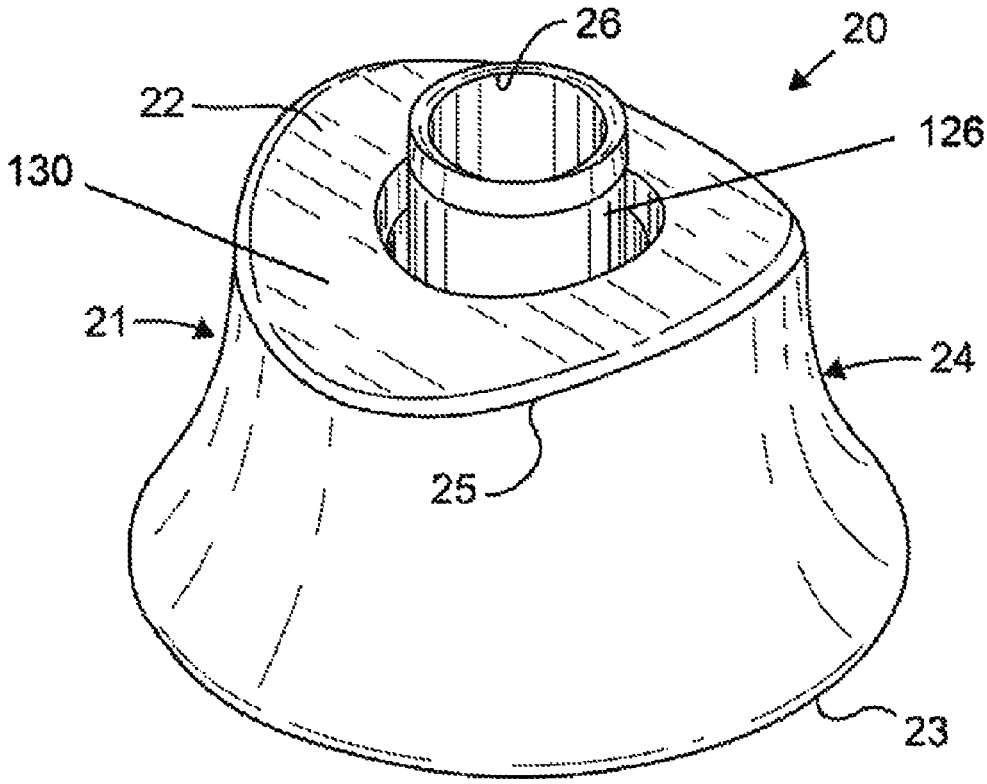
FIG. 1 is a perspective view of a closure for a container according to an embodiment of the present invention.

All drawings are schematic and not actual physical representations of the articles, components or systems described herein, and are further not drawn to scale. The drawings should be interpreted accordingly.

DETAILED DESCRIPTION

The following description, which is illustrative of certain embodiments according to principles of the present invention, is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected" refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Figure 2:
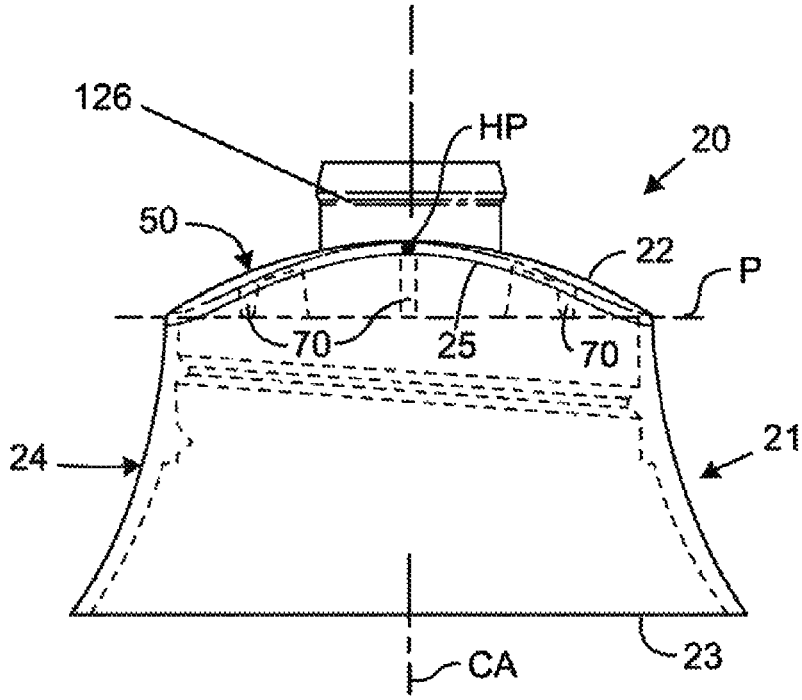
FIG. 2 is a first side view showing a convex portion of the top wall of the closure of FIG. 1.
Figure 3:
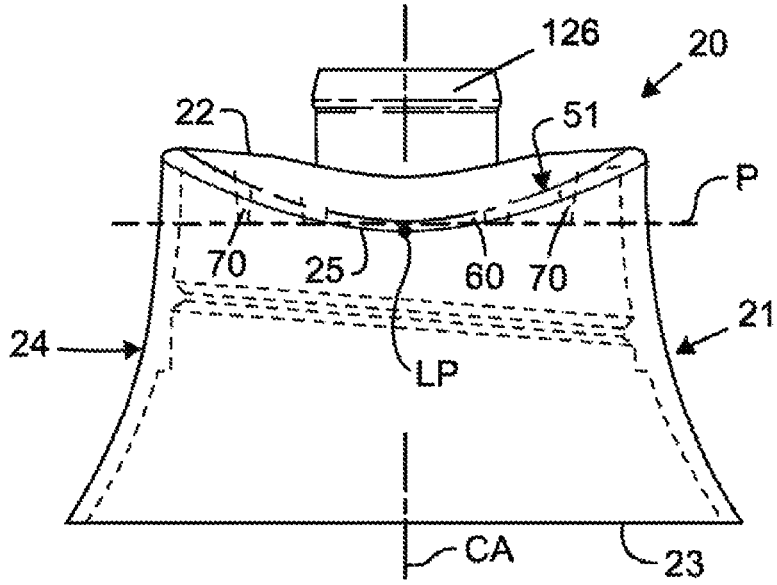
FIG. 3 is a second side view thereof showing a concave portion of the top wall of the closure of FIG. 1.

Referring first to FIGS. 1-3 concurrently, a closure 20 according to one embodiment of the present invention is exemplified. The closure 20 is designed to be secured to a container, and more preferably a liquid filled container. The closure 20 may be formed of any suitable material, including without limitation a plastic material, such as polypropylene, polyethylene, and/or combinations thereof. Of course, other plastics can be used to form the closure as is known in the art. In one preferred embodiment, the material of construction is polypropylene. The material selected for the closure 20 may further be at least partially resilient to form a liquid seal with the container, as further described herein. The closure 20 may be fabricated by any suitable fabrication technique used in the art, including for example, without limitation, compression or injection molding.

The closure 20 includes a body 21 having a radially-extending top wall 22 and an annular skirt or sidewall 24 extending from the top wall 22 in an axial direction. More specifically, the annular sidewall 24 extends from the top wall 22, along the periphery of the top wall 22, thereby circumferentially surrounding the central axis CA of the closure 20 and forming an interior cavity 33. A circumferentially-extending upper edge 25 is formed at the junction of the sidewall 24 and the top wall 22, thereby delineating a peripheral edge of the top wall 22. In the illustrated embodiment, the sidewall 24 may include a lower portion that gradually flares outward from the central axis CA. The exact configuration of the sidewall 24, however, is not limiting of the present invention. The sidewall 22 may be provided in a wide variety of suitable configurations to match the aesthetic configuration of the corresponding container, which may also be of any suitable configuration.

The bottom 23 end of the body 21 is open, thereby forming a passageway into the interior cavity 33 through which a neck portion 41 of a container 40 (see, e.g. FIG. 8) can be inserted into the closure 20. The top end of the body 21 is closed so that the closure 20 can be used to seal an opening of the neck portion 41 of the container 40 when secured thereto. Of course, in certain embodiments, the close top end of the body 21 may be adapted so that liquid from the container can be dispensed via the closure 20 in a controlled manner.

For example, in the illustrated embodiment, the top wall 22 includes an aperture 26 for dispensing liquid from the container 40 when the closure 20 is mounted to the container. The aperture 26 may be of any suitable configuration or structure. In the illustrated embodiment, the aperture 26 is defined by a cylindrical spout 126 that extends axially upward from a top surface 130 (FIG. 1) of the top wall 22. The cylindrical spoutl 26 (and aperture 26) may be used alone for dispensing liquid or may be configured to be operably coupled to a slidable push-pull type nozzle (not shown), which can be slid between an open position in which liquid from the container can be dispensed via the aperture 26 and a closed position in which the aperture 26 is sealed. Such push-pull type nozzles are known in the art. In other embodiments, various other types and shapes of apertures and nozzle structures may be provided.

Alternatively, the top end of the closure 20 may be completely closed without any apertures or openings formed therein. Accordingly, the invention is not limited by any particular shape or type of liquid dispensing means that may be furnished with the closure 20.

Figure 4:
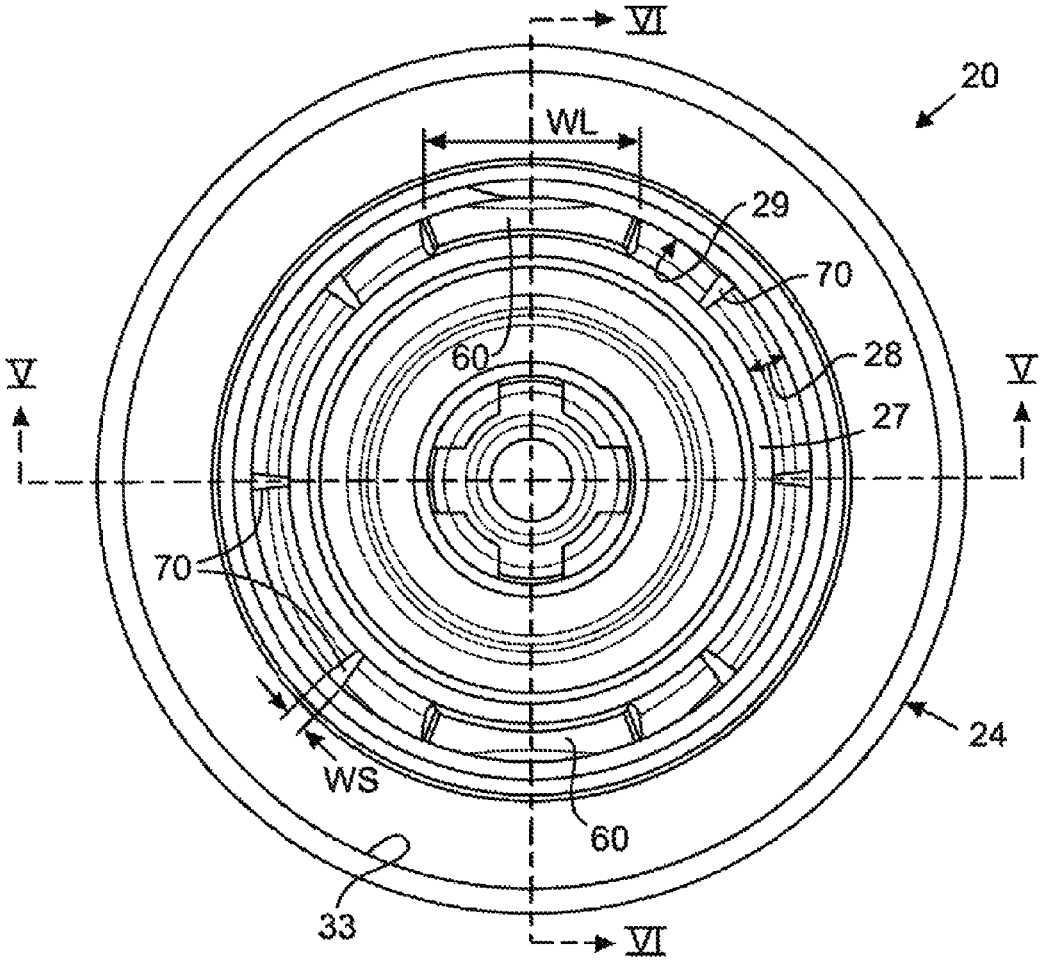
FIG. 4 is a bottom view of the closure of FIG. 1.
Figure 5:
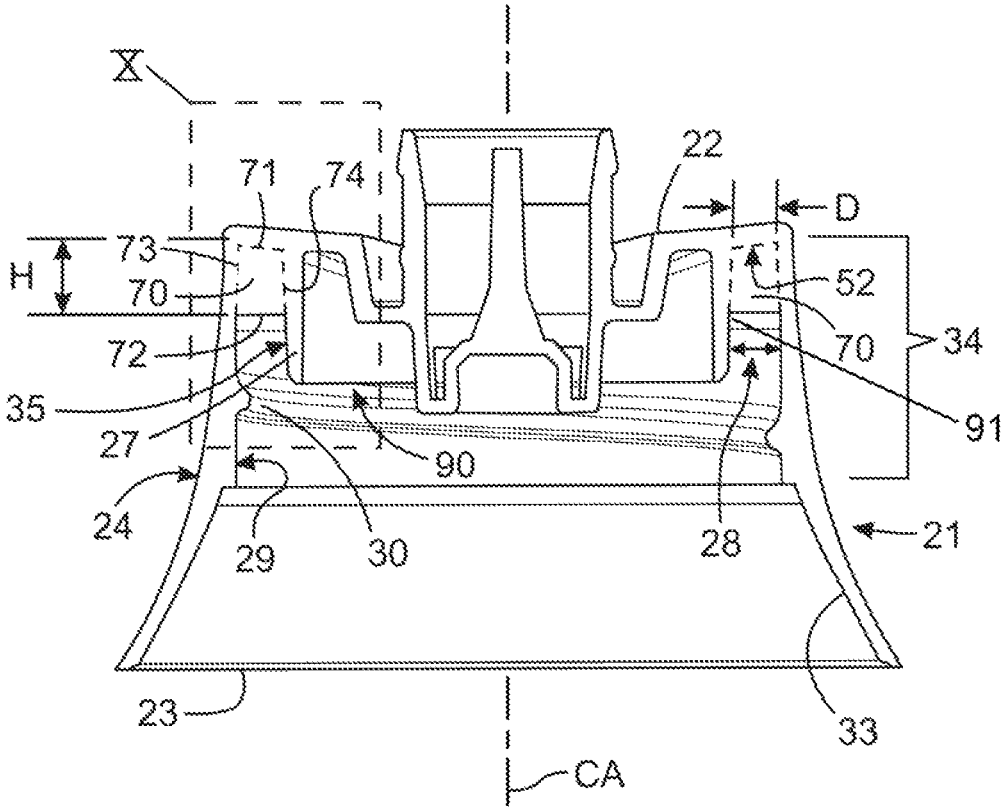
FIG. 5 is a side cross-sectional view taken along plane V-V in FIG. 4.
Figure 6:
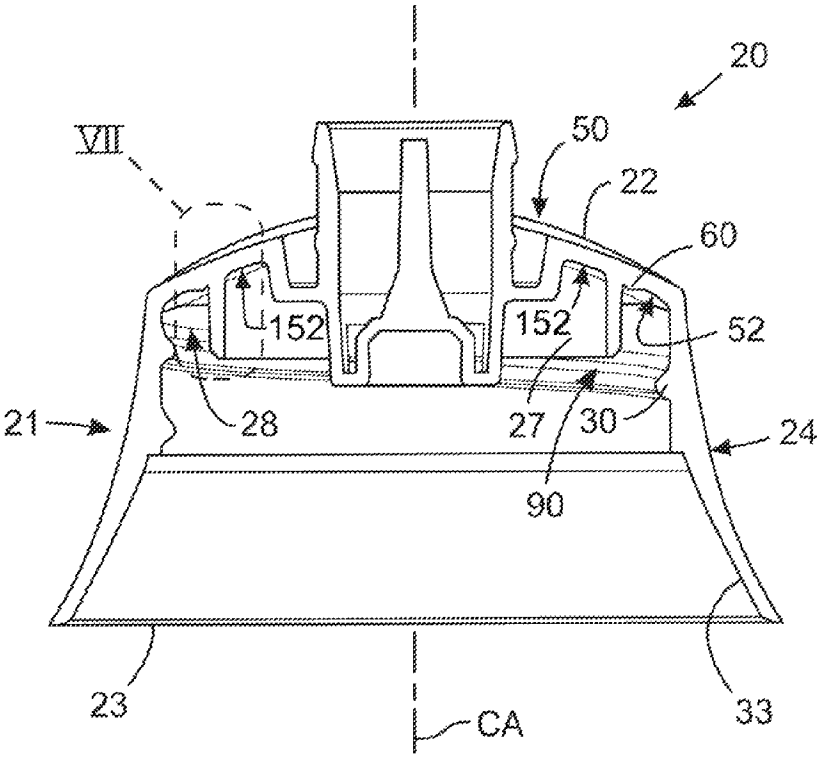
FIG. 6 is a side cross-sectional view taken along plane VI-VI in FIG. 4.
Figure 8:
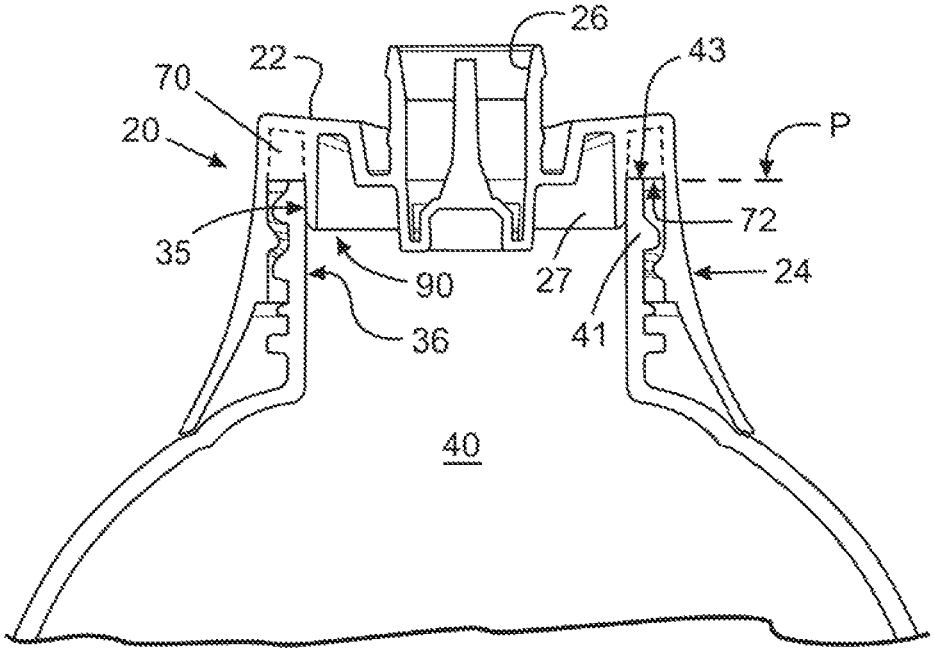
FIG. 8 is transverse cross-sectional view of the closure of FIG. 1 fully seated on a container according to an embodiment of the present invention.

Referring now to FIGS. 4-6 concurrently, as mentioned above, the top wall 22 and the sidewall 24 of the closure 20 define an interior cavity 33 for receiving the neck portion 41 of container 40 (see, e.g. FIG. 8). The closure 20 further includes a plug 90 that circumferentially surrounds the central axis CA. When the closure 20 is mounted to the container 40, the plug 90 forms a primary circumferential liquid seal via surface contact between an annular axial exterior surface 91 of the plug 90 and an annular axial interior surface 36 of the neck portion 41 of the container 40. The plug 90 is a cylindrical structure that extends axially downward from the top wall 22. Depending on the type of closure 20 desired, the plug 90 may be a solid cylinder or a tubular cylinder.

Figure 7:
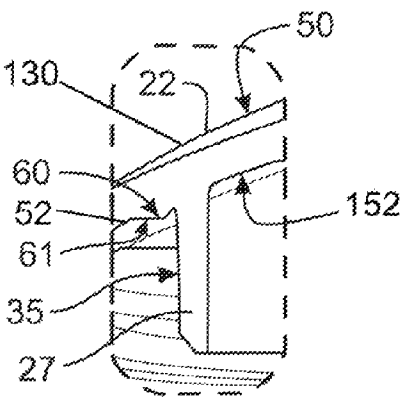
FIG. 7 is a detailed view of area VII of FIG. 6, showing a portion of a sealing tube and a stop lug of the closure of FIG. 1.
Figure 9:
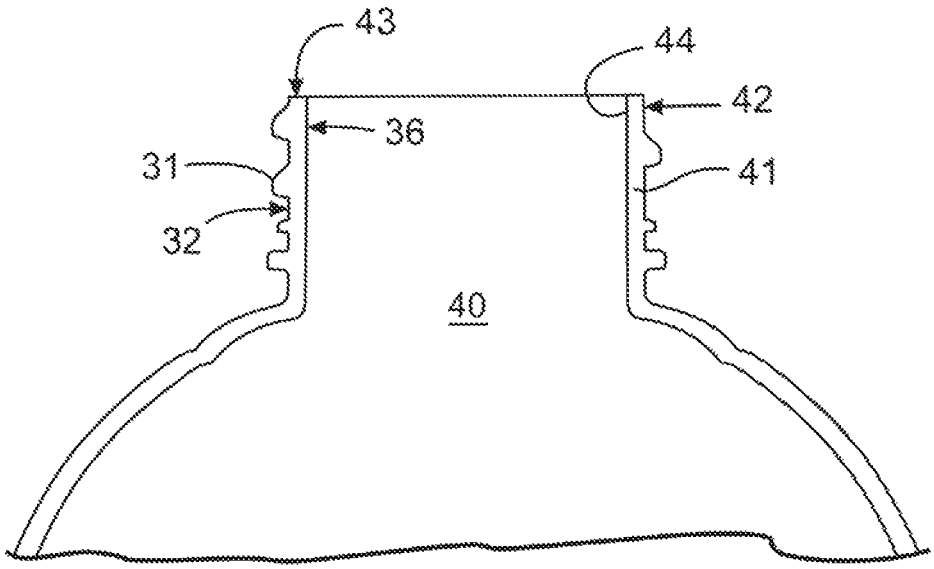
FIG. 9 is a transverse cross-sectional side view of the container of FIG. 8 with the closure removed.

In the exemplified embodiment, the plug 90 is in the form of a cylindrically shaped annular sealing tube 27, which is disposed within interior cavity 33 of the body 21 and extends axially downward from the underside 152 of the top wall 22. The sealing tube 27 engages the neck portion 41 of the container 40 when the closure 20 is threaded onto the container 40 to establish the hermetic seal. Preferably, the sealing tube 27 is configured and adapted to provide a relatively snug frictional fit between the container neck portion 41 and the tube 27. To this extent, the sealing tube 27 includes a radially outward facing annular axial sealing surface 35 (see, e.g. FIGS. 5 and 7) configured for engaging a complementary radially inward facing annular axial sealing surface 36 (see, e.g. FIGS. 8 and 9) on the container neck portion 41. The sealing tube 27 is preferably structured to be at least partially resilient and deformable when engaged with the neck portion 41 of the container 40 to enhance the tightness of the liquid seal.

Referring now to FIGS. 5 and 6 concurrently, the sidewall 24 circumferentially surrounds the sealing tube 27 (both of which are concentric to the central axis CA) in a spaced apart manner so that an annular space 28 is formed within the interior cavity 33. The annular space 28 is formed below the top wall 22 and between the sidewall 24 and the sealing tube 27. More specifically, the annular space 28 is formed between the radially outward facing annular axial sealing surface (also referred to as an exterior axial annular surface) 35 of the sealing tube 27 and the interior axial annular surface 29 of the sidewall 24. The annular space 28 has an open bottom end so that the annular space 28 is in spatial communication with the remainder of the interior cavity 33 and a closed top end, which is delimited by a bottom surface 52 of the top wall 22. The bottom surface 52 is a section of the underside 152 of the top wall 22 that forms a roof of the annular space 28. Thus, in the illustrated embodiment, the bottom surface 152 is an annular surface. The annular space 28 is configured for receiving and securing the upper part of the container neck portion 41 when the closure 20 is fully seated on the container 40, as further described herein.

In some embodiments, the closure 20 may be removably secured to the container 40 via a conventional threaded connection. Accordingly, the closure 20 may include a generally cylindrically-shaped coupling portion 34, which in turn included an internal thread finish configured for threadily engaging a corresponding external thread finish provided on the container neck portion 41. In one embodiment, with reference to FIGS. 5, 8, and 9, one or more internal threads (or thread segments) 30 are provided on the interior axial surface 29 of the closure 20 on the coupling portion 34 that threadily mate with complementary external threads (or thread segments) 31 formed on the axial exterior surface 32 of the container neck portion 41. Of course, any suitable conventional thread finish may be used for the closure 20 and the container 40 as desired. In one example, without limitation, a finish of 28/400 may be used.

In other possible embodiments, the closure 20 may be permanently or semi-permanently attached to the container 40 via other suitable attachment means used in the art, including without limitation a snap-fit, friction fit, adhesives, heat welded seams, and/or combinations thereof. Stated simply, the invention is not limited to threaded attachment between the container 40 and the closure 20 in all embodiments.

Referring again to FIGS. 1-3 and 5-8 concurrently, the top wall 22 of the closure 20 has a bottom surface 52 (and top surface 130) that is not substantially planar (or flat) as is the case with prior known closure embodiments. Instead, in the exemplified embodiment, the top wall 22 of the closure 20 has a saddle-shaped top surface 130 that includes a combination of undulating surfaces extending radially outwards from the central axis CA of the closure 20. When viewed from the sides of the closure 20, the top surface 130 of the top wall 22 includes two convex surface sections 50 disposed on opposite portions of the top wall 22 (see FIGS. 2 and 6) and two adjacent concave surface sections 51 (see, e.g. FIGS. 3 and 5) disposed on opposite portions of the top. Accordingly, the top surface 130 of the top wall 22 has a shape that circumferentially alternates between convex surface sections 50 and concave surface sections 51. In one possible embodiment, as illustrated, a gradual transition may be provided between the convex and concave surface sections 50, 51 such that the upper edge 25 extends circumferentially in a manner that defines an undulating sinusoidal shape when the closure 20 is viewed from the side and rotated 360 degrees around. It should be noted that in the exemplified embodiment, the bottom surface 52 of the top wall 22 has an undulating contour that follows the undulating contour of the top surface 130. Thus, the above description is applicable to the bottom surface 152 of the top wall 122, with the terms convex and concave being alternated of course.

The convex surface sections 50 define two peaks or high points HP disposed at diametrically-opposed points on the upper edge 25 of the closure 20 located along a first transverse axis TA1 across the top wall 22 (see FIGS. 2 and 4). The first transverse axis TA1 is parallel with and includes the central axis CA. Contrastingly, the concave surface sections 51 define two valleys or low points LP disposed at diametrically-opposed points on the upper edge 25 located along a second transverse axis TA2 on the top wall 22 (see FIGS. 3 and 4). The second transverse axis TA2 is also parallel with and includes the central axis CA. The first and second transverse axes Ta1, TA2 are orthogonal to one another (i.e., oriented a circumferential 90 degree angle to each other) in this embodiment.

As best shown in FIGS. 5 and 6, the top wall 22 includes the bottom surface 52 (which acts as an interior radial landing surface) disposed within annular space 28 on the underside 152 of the top wall 22 as mentioned above. The bottom surface 52 has an undulating contour that follows the corresponding rising and falling contour of the convex and concave surface sections 50, 51 of the top surface 130, but internally (see, e.g. FIGS. 2 and 3). The undulating contour of the bottom surface 52 of the top wall 22 also generally follows the pattern of the upper edge 25. When the closure 20 is screwed onto the threaded neck portion 41 of the container 40, however, the flat upward facing radial rim surface 43 defined by the neck rim 42 of the neck portion 41 (see FIG. 8) at the opening 44 of the container 40 would be prevented from squarely seating on and abutting corresponding sections of the closure's interior radial landing surface 52. This is desired to properly balance and seat the closure on the container for establishing a uniform and tight liquid seal between the cylindrical sealing tube 27 and the container neck portion 41 as already described herein. Thought of another way, the bottom surface 52 of the top wall 22 is not coplanar with a reference plane that is substantially parallel to a seating plane formed by the rim surface 43. Thus, the bottom surface 52 rest atop the rim surface 43 with any rigidity or structural integrity.

To partially address the foregoing contour mismatch between the container rim 42 and the bottom surface 52 of the top wall 22, a laterally broadened and elongated stop lug 60 is provided at each of the two low points LP as shown in FIGS. 3, 4, 6 and 7. In one embodiment, the stop lugs 60 may be formed as slightly raised portions of the bottom surface 52 on the underside 152 of the top wall 22. In an alternative embodiment, portions of the bottom surface 52 itself (at the low points LP) may simply form the lugs without any protrusions or manipulation of the undulating contour of the bottom surface 52. The stop lugs 60 are configured and adapted to provide a relatively flat seating surface 61 for engaging the upward facing flat radial rim surface 43 on the rim 42 of container neck portion 41 when closure 20 is fully seated on the container. Thought of more broadly, the flat seating surface 61 (which are the bottom surfaces) of the lugs 60 lie within the reference plane that is substantially parallel with the seating plane formed by the rim surface 43.

In the illustrated embodiment, the stop lugs 60 are disposed on diametrically-opposed portions of the closure 20 and angularly spaced 180 degrees apart. The stop lugs 60 are preferably elongated in a lateral (or circumferential) direction perpendicular to the closure central axis CA, as best shown in FIGS. 3 and 4, and have a width WL. The width WL of the stop lugs 60 is preferably at least twice the width WS of the supporting struts 70 (described below), and more preferably at least four times larger than the width WS. The lugs 60 each bridge one of the valleys or low points LP on the closure 20. The stop lugs 60 are thus intended to assist in balancing the closure 20 on the container neck portion 41 and preventing over-torqueing of the closure 20 onto the container 40, especially by automated equipment on a liquid fill processing line.

It has been discovered through trial testing by the inventors, however, that the stop lugs 60 alone do not completely resolve the contour mismatch problems associated with the undulating contour of the bottom surface 52 of the closure's top wall 22. When the closure 20 is threaded onto the neck portion 41 of the container 40, the stop lugs 60 initially engage the upward facing radial rim surface 43 defined on the container neck portion 41, thereby resisting the axial forces applied to the closure 20 during tightening of the closure 20 onto the container 40. The stop lugs 60 only provide support for the closure 20 at two positions angularly spaced 180 degrees apart, thereby leaving other circumferential portions of the closure unsupported to resist the axial tightening forces. As a result, it has been discovered that the lower or bottom portions of the sidewall 24 that are located 90 degrees apart from the stop lugs 60 (which correspond to the closure high points HP (see FIGS. 2-4)) tend to pinch and deflect radially inwards as torque is applied to the closure 20, despite the engagement by the bottom surfaces 61 of the lugs 60. This pinching and deflection distorts the closure 20 and creates ovality in shape, which in turn results in leakage at the primary seal formed between the plug 90 and the neck portion 41 (described above).

Referring now to FIGS. 2-5, the closure 20 preferably further includes a plurality of closure supporting struts 70 to augment (or replace) the stop lugs 60 for eliminating or reducing the leakage problem at the primary seal. In one possible embodiment, as shown, the supporting struts 70 are disposed in the interior cavity 33 and are arranged in a circumferentially spaced apart manner about the central axis CA between the stop lugs 60. Preferably, the supporting struts 70 are evenly/uniformly spaced apart from one another in the circumferential zones created between the lugs 60. The supporting struts 70 are disposed in and span radially across the annular space 28, as best shown in FIGS. 4 and 5. Preferably, the struts 70 are rigidly attached along three of their sides to the closure 20. The struts 70 are each attached to both the interior axial surface 29 of the sidewall 24 along a first vertical side 73 and the annular axial sealing surface 35 of the sealing tube 27 along an opposite second vertical side 74. The top of each supporting strut 70 is also attached to the bottom surface 52 of the underside 152 of the top wall 22 along a third horizontal side or upper end 71 of the strut 70. However, in alternative embodiments, the struts 70 may be attached to only of the aforementioned surfaces and/or structures if desired.

Figure 10:
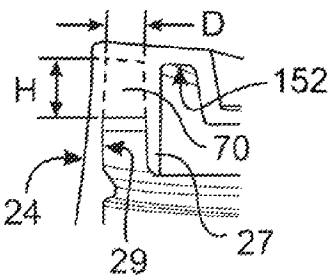
FIG. 10 is a detailed view of area X of FIG. 6, showing a portion of a sealing tube and stop lug of the closure of FIG. 1.

With continuing reference to FIGS. 2-5, the supporting struts 70, in one possible embodiment, preferably each have the same radial or lateral cross-sectional shape as will be apparent by particular reference to FIG. 4, which shows the underside 152 of the closure 20. Any suitable cross-sectional shape may, however, be provided for supporting struts 70. In some embodiments, supporting struts 70 may have a generally rectangular radial/lateral cross section or be slightly wedge-shaped as shown in FIG. 4. so as to have a gradually increasing horizontal width W traveling radially outwards from the closure central axis CA. The supporting struts 70 preferably have radial depth D that is coextensive with the depth or width of annular space 28, as best shown in FIGS. 5 and 10.

Referring to FIGS. 2-3, 5, and 10, the supporting struts 70 have varying heights H (measures from their bottom surfaces 72 to the bottom surface 52 of the top wall 22) since the upper end 71 of each strut is preferably attached to the bottom surface 52 of the underside 152 of the top wall 22. As best shown in FIGS. 2 and 3, therefore, the height of each strut H will vary with respect to the undulating contour of the bottom surface 52 that follows the undulating contour of the top surface 130 (and upper edge 25) of the top wall 22, as already described herein. In order to ensure that each supporting strut 70 squarely rests on the flat upward facing radial rim surface 43 on the rim 42 of the container neck portion 41 (see FIG. 9) when the closure 20 is fully seated on the container 40, the bottom surfaces 72 of the struts 70 preferably lie within (i.e., collectively form) an imaginary reference plane P which is substantially parallel with the seating plane formed by the rim surface 43. In the illustrated embodiment, this imaginary reference plane is a horizontal seating pane P that is substantially perpendicular to the central axis CA, as best shown in FIGS. 2, 3, and 8. This horizontal seating plane P is, therefore, coplanar with the seating plane formed by the radial surface 43 of container neck portion 41 when the closure 20 is fully seated on the container 40 (see FIG. 8). Preferably, the bottom surfaces 72 of the supporting struts 70 and the bottom surfaces 61 of stop lugs 60 all therefore lie within and collectively form the same seating plane P. As a result, the bottom surfaces 61 of the lugs 60 and the bottom surfaces 72 of the struts 70 simultaneously come into surface contact with the rim surface 43 of the container neck portion 41 (allowing for fabrication dimensional tolerances) to balance the closure 20 and axial forces imparted to the closure 20 via the neck portion 41 when the closure 20 is threaded onto the container 40. Preferably, the bottom surfaces 61 of the lugs 60 and the bottom surfaces 72 of the struts 70 are flat surfaces. The invention, however, is not so limited in all embodiments.

Referring still to FIGS. 2-5, at least two supporting struts 70 are provided that are angularly spaced at 90 degrees apart from the stop lugs 60, as best shown in FIG. 4, to coincide with the location of the high points HP. In conjunction with the stop lugs 60, this provides four contact points each at 90 degrees apart between the closure 20 and the upward facing radial surface 43 at the rim 42 of the container neck portion 41. Advantageously, the combination of the supporting struts 70 and the stop lugs 60 balances and evenly distributes the axial forces exerted on the closure 20 when it is screwed onto the container neck portion 14. In addition, the supporting struts 70 radially reinforce the closure 20 and the sealing tube 27 to prevent or minimize lateral distortion and ovality. These combined effects eliminate or minimize leakage at the primary plug seal 90.

In a preferred embodiment, at least six supporting struts 70 are provided which may be angularly spaced at even intervals of 45 degrees apart between stop lugs 60 as shown in FIG. 4. These additional contact points between the neck portion 41 of the container 40 and the closure 20 further enhance the liquid tight seal. In a preferred embodiment, the supporting struts 70 may be molded as an integral part of the closure 20 during the closure molding process.

It will be appreciated that a closure for a container formed according to principles of the present invention may have a top or upper radial surface with various irregular or non-uniform shapes other than the saddle-shape disclosed herein so long as a common seating plane is established by the bottom surfaces of the supporting struts and/or the bottom surfaces of the lugs. Such alternate embodiments contemplated may include, for example, more angularly shaped surfaces disposed and intersecting at varying angles with distinct transitions rather than smoothly contoured and transitioning surfaces as disclosed herein. Accordingly, the invention is not limited to the top surface shape disclosed herein or any particular shapes.

It will be understood that while the invention has been described in conjunction with specific embodiments thereof, the foregoing description and examples are intended to illustrate, but not limit the scope of the invention. Other aspects, advantages and modifications will be apparent to those skilled in the art to which the invention pertains, and these aspects and modifications are within the scope of the invention and described and claimed herein.

What is claimed is:

1. A container comprising:

a container neck forming an opening about an axis, the container neck comprising a rim surface that defines a seating plane;

a closure body comprising:

a top wall extending radially from the axis;

a plug extending axially from the top wall, the plug circumferentially surrounding the axis;

a sidewall extending axially from the top wall and circumferentially surrounding the plug so as to form an annular space between the sidewall and the plug;

a bottom surface of the top wall defining a roof of the annular space, the bottom surface of the top wall being non-coplanar with a reference plane that is substantially parallel to the seating plane; and a plurality of circumferentially spaced-apart struts in the annular space, each of the struts having a bottom surface that collectively define the reference plane, wherein the bottom surface of the top wall has an undulating contour extending circumferentially, wherein the top wall comprises a top surface having an undulating contour that follows the undulating contour of the bottom surface, the top surface having a convex cross-sectional profile viewed along a first plane that includes the axis, and the top surface of the top wall having a concave cross-sectional profile viewed along a second plane that includes the axis, the first and second planes being substantially orthogonal to one another;

the closure body secured to the container neck, the container neck extending into the annular space so that the rim surface of the container neck contacts the bottom surfaces of the struts, the plug extending into the opening of the container neck and forming a seal with the container neck; and wherein each of the struts is attached to an exterior axial surface of the plug, an interior axial surface of the sidewall, and the bottom surface of the top wall, each of the struts have a height measured from the bottom surface of the top wall to the bottom surface of the strut, and the closure body comprises struts having at least two different heights.

2. The container of claim 1 further comprising at least one lug formed into the bottom surface of the top wall at a low point of the bottom surface of the top wall, the lug comprising a bottom surface that lies within the reference plane, the rim surface of the container neck contacting the bottom surface of the lug.

3. The container of claim 2 comprising two of the lugs, a first of the lugs formed into the bottom surface of the top wall at a first low point, a second of the lugs formed into the bottom surface of the top wall at a second low point, and wherein the first and second low points are diametrically-opposed.

4. The container of claim 3 wherein the bottom surface of the lug is flat and circumferentially elongated.

5. The container of claim 1 wherein an annular edge is formed at a junction of the sidewall and the top wall, the annular edge undulating so that the annular edge has a sinusoidal shape when the closure body is viewed from a side and rotated about the axis.

6. The container of claim 1 wherein the top wall comprises an aperture for dispensing liquid, wherein the aperture is formed by a spout extending axially from a top surface of the top wall.

7. The container of claim 1 wherein an interior axial surface of the sidewall comprises threads that mate with threads on an exterior axial surface of the container neck.

8. The container of claim 1 wherein the struts extend between the plug and the sidewall.

9. A closure for sealing a liquid container comprising:

an axis;

a top wall extending radially from the axis;

a plug extending axially from the top wall, the plug circumferentially surrounding the axis;

a sidewall extending axially from the top wall and circumferentially surrounding the plug so as to form an annular space between the sidewall and the plug;

a bottom surface of the top wall defining a roof of the annular space, the bottom surface of the top wall being non-coplanar with a reference plane that is substantially perpendicular to the axis;

a plurality of circumferentially spaced-apart struts in the annular space, each of the struts having a bottom surface that collectively define a seating plane that is substantially perpendicular to the axis, wherein the bottom surface of the top wall has an undulating contour extending circumferentially, wherein the top wall comprises a top surface having an undulating contour that follows the undulating contour of the bottom surface, the top surface having a convex cross-sectional profile viewed along a first plane that includes the axis, and the top surface of the top wall having a concave cross-sectional profile viewed along a second plane that includes the axis, the first and second planes being substantially orthogonal to one another; and wherein an interior axial surface of the sidewall comprises threads, wherein each of the struts is attached to an exterior axial surface of the plug, the interior axial surface of the sidewall, and the bottom surface of the top wall, wherein each of the struts have a height measured from the bottom surface of the top wall to the bottom surface of the strut, and wherein the closure comprises struts having at least two different heights.

10. The closure of claim 9 wherein the bottom surface has a plurality of low points and a plurality of high points resulting from the undulating contour and at each low point, a lug formed into the bottom surface of the top wall and comprising a bottom surface, the bottom surfaces of the lugs collectively defining a seating plane that is substantially perpendicular to the axis.

11. The closure of claim 9 further comprising a first lug formed into the bottom surface of the top wall at a first low point of the bottom surface of the top wall, a second lug formed into the bottom surface of the top wall at a second low point of the bottom surface of the top wall, the first and second low points being diametrically-opposed, and each of the first and second lugs having a bottom surface that lies within the seating plane.

12. The closure of claim 11 wherein the bottom surfaces of the first and second lugs have a width that is greater than a width of the bottom surfaces of the struts.

13. The closure of claim 9 wherein the top wall comprises an aperture for dispensing liquid, wherein the aperture is formed by a spout extending axially from a top surface of the top wall.

14. The closure of claim 9 wherein the struts extend between the plug and the sidewall.

15. A closure for sealing a liquid container comprising:

an axis;

a top wall extending radially from the axis;

a plug extending axially from the top wall, the plug circumferentially surrounding the axis;

a sidewall extending axially from the top wall and circumferentially surrounding the plug so as to form an annular space between the sidewall and the plug;

a bottom surface of the top wall defining a roof of the annular space, the bottom surface of the top wall having an undulating contour extending circumferentially, the bottom surface having a plurality of low points and a plurality of high points resulting from the undulating contour;

at each low point, a lug formed into the bottom surface of the top wall and comprising a bottom surface, the bottom surfaces of the lugs collectively defining a seating plane that is substantially perpendicular to the axis, an annular edge formed at a junction of the sidewall and the top wall, the annular edge undulating so that the annular edge has a sinusoidal shape when the closure body is viewed from a side and rotated about the axis; and wherein each of the struts having a height measured from the bottom surface of the wall to the bottom surface of the strut, and wherein the plurality of struts having at least two different heights.

16. The closure of claim 15 comprising first and second low points in a diametrically-opposed arrangement.

17. The closure of claim 15 further comprising a plurality of circumferentially spaced-apart struts in the annular space, each of the struts having a bottom surface that lies within the seating plane.

18. The closure of claim 15 wherein the bottom surfaces of the lugs are flat surfaces.

19. The closure of claim 15 wherein the top wall comprises a top surface having an undulating contour that follows the undulating contour of the bottom surface.

20. The closure of claim 19 wherein a top surface of the top wall has a convex cross-sectional profile viewed along a first plane that includes the axis, and the top surface of the top wall has a concave cross-sectional profile viewed along a second plane that includes the axis, the first and second planes being substantially orthogonal to one another.

21. The closure of claim 15 wherein an interior axial surface of the sidewall comprises threads.

22. The closure of claim 17 wherein each of the struts is attached to an exterior axial surface of the plug, an interior axial surface of the sidewall, and the bottom surface of the top wall.

* * * * *